US010349722B2

(12) United States Patent
Yasumi

(10) Patent No.: US 10,349,722 B2
(45) Date of Patent: Jul. 16, 2019

(54) ROD-SHAPED COSMETIC MATERIAL FEEDING CONTAINER

(71) Applicant: TOKIWA CORPORATION, Gifu (JP)

(72) Inventor: Risa Yasumi, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 107 days.

(21) Appl. No.: 15/478,597

(22) Filed: Apr. 4, 2017

(65) Prior Publication Data

US 2017/0295907 A1 Oct. 19, 2017

(30) Foreign Application Priority Data

Apr. 14, 2016 (JP) ..... 2016-81369

(51) Int. Cl.
*B43K 21/08* (2006.01)
*A45D 40/20* (2006.01)

(52) U.S. Cl.
CPC ..... *A45D 40/205* (2013.01); *A45D 2040/208* (2013.01); *A45D 2200/1072* (2013.01)

(58) Field of Classification Search
CPC ..... A45D 40/205; A45D 2040/208; A45D 2200/072
USPC ..... 401/68, 75
See application file for complete search history.

(56) References Cited

U.S. PATENT DOCUMENTS 2,442,503 A * 6/1948 Melnikoff ..... A45D 40/04 132/320
2,461,790 A * 2/1949 Vaughn ..... A45D 40/06 401/78
2,491,723 A * 12/1949 Gelardin ..... A45D 40/04 132/320
2,491,724 A * 12/1949 Gelardin ..... A45D 40/04 401/79
7,891,896 B2 * 2/2011 Nasu ..... A45D 40/04 401/65
9,044,078 B2 * 6/2015 Tani ..... A45D 34/042
(Continued)

FOREIGN PATENT DOCUMENTS

FR 2994805 A1 3/2014
JP 2012-96009 5/2012
(Continued)

OTHER PUBLICATIONS

French Preliminary Search Report issued in FR1753210, dated Feb. 12, 2019.

*Primary Examiner* — Jennifer C Chiang
(74) *Attorney, Agent, or Firm* — Greenblum & Bernstein, P.L.C.

(57) ABSTRACT

A rod-shaped cosmetic material feeding container having a movable body housed in a container main body in which the movable body advances by an operation of an operating portion. A rod-shaped cosmetic material is fed by the advance of the movable body to project from an opening of a leading tube. The leading tube has the tip end and a main body, the tip end being made of a soft material, the main body being installed consecutively to the tip end and extending in an axial direction. Further, the main body of the leading tube is made of a hard material and has an elongated tube hole (e.g., having a drop or rhombic shape in cross-section) formed inside. A top end surface on the tip end has a tapered surface tapered to peak at an outside surface of the tip end when viewed from a tip side.

20 Claims, 20 Drawing Sheets

(56) References Cited

U.S. PATENT DOCUMENTS

| | | | | |
|---|---|---|---|---|
| 9,392,858 | B2 * | 7/2016 | Tani | A45D 40/26 |
| 9,844,254 | B2 * | 12/2017 | Kim | A45D 40/06 |
| 10,028,567 | B2 * | 7/2018 | Lee | A45D 40/06 |
| 2012/0076568 | A1 | 3/2012 | Tani | |
| 2018/0020809 | A1 * | 1/2018 | Soga | A45D 40/205<br>401/88 |

FOREIGN PATENT DOCUMENTS

| | | | |
|---|---|---|---|
| JP | 2014-200532 | | 10/2014 |
| JP | 2014-221147 | | 11/2014 |
| KR | 1748790 | B1 * | 6/2017 |

* cited by examiner

ROD-SHAPED COSMETIC MATERIAL FEEDING CONTAINER

TECHNICAL FIELD

The present invention relates to a rod-shaped cosmetic material feeding container that can feed a rod-shaped cosmetic material.

BACKGROUND ART

Conventionally, there has been widely used a rod-shaped cosmetic material feeding container that advances and retreats a movable body housed in the container through a relative rotation of a front portion of the container to a rear portion of the container to cause a rod-shaped cosmetic material supported to a tip of the movable body to appear from an opening at the front portion of the container (for example, see Patent Literature 1).

There has been known a makeup method to apply an eyeline that sweeps up the eyeline so as to be tapered at a corner of an eye. Such makeup method generally tapers and sweeps up an eyeliner, which is a liquid cosmetic material, using a brush to apply the eyeline.

CITATION LIST

Patent Literature

Patent Literature 1: Japanese Unexamined Patent Application Publication No. 2012-96009

Technical Problem

Because of the good usability, it is desired to apply a tapered winged line with the rod-shaped cosmetic material feeding container as described above. However, while the eyeline with a constant thickness (a thickness of the rod-shaped cosmetic material) is drawn on an edge of an eyelid, the tapered winged line is needed to be applied to the corner of the eye. Therefore, it is difficult to apply the tapered line easily and beautifully.

Therefore, an object of the present invention is to provide a rod-shaped cosmetic material feeding container that can easily and beautifully form a tapered line such as an eyeline using a rod-shaped cosmetic material.

SUMMARY OF INVENTION

A rod-shaped cosmetic material feeding container according to the present invention includes a movable body and a leading tube. The movable body is housed in a container main body and advances by an operation of an operating portion. The leading tube is positioned on a front side of the container main body. A rod-shaped cosmetic material is housed in a tube hole of the leading tube, the rod-shaped cosmetic material having a shape similar to an opening on a tip end of the leading tube when viewed from a tip side, the rod-shaped cosmetic material being fed by the advance of the movable body to project from the opening. The leading tube has the tip end and a main body, the tip end being made of a soft material, the main body being installed consecutively to the tip end and extending in an axial direction, the main body being made of a hard material. A top end surface on the tip end has a tapered surface tapered to peak to an outside viewed from a tip side.

This rod-shaped cosmetic material feeding container ensures easily and beautifully forming a tapered line with good touch as follows. The tapered surface is positioned at an upstream when a line is formed. The rod-shaped cosmetic material is touched on an applied portion to draw a line with a constant thickness. When the application comes to a stage of an application of a tapered line, an angle of the rod-shaped cosmetic material feeding container is changed such that the tapered surface touches the applied portion and the rod-shaped cosmetic material separates from the applied portion. Then, the line is drawn such that the tapered surface on the tip end made of the soft material rubs the applied portion.

Here, as a configuration to suitably produce the above-described action, specifically, the following configuration can be listed: the top end surface is an inclined surface inclined to a vertical cross-sectional surface with respect to an axis center of the leading tube, and the inclined surface has the tapered surface on a tip side. Such configuration allows applying the line with the inclined container while a mirror is seen; therefore, the container does not hinder the application.

As a configuration to suitably produce the above-described action, specifically, the following configuration can be listed: an outer edge of the top end surface including the tapered surface has a drop shape in an axial direction view. With such configuration, the simple shape, the drop shape, allows forming the beautiful tapered line.

As a configuration to suitably produce the above-described action, specifically, the following configuration can be listed: a part of the tip end is a projection, the projection extending forward to cover the rod-shaped cosmetic material in an eaves shape, and a top end surface of the projection has the tapered surface.

It is also preferable that the opening and the rod-shaped cosmetic material have a shape with an outline tapered in a direction identical to an outer edge of the tapered surface viewed from a tip side. With this configuration, at a point when the angle of the rod-shaped cosmetic material feeding container is changed such that the tapered surface on the tip end touches the applied portion and the rod-shaped cosmetic material separates from the applied portion, the tapered line has already been applied by the tip cosmetic material surface surrounded by the tapered outline of the rod-shaped cosmetic material. The tapered surface of the tip end rubs the tapered line, thereby ensuring forming the further beautifully tapered line.

As described above, the tapered surface serves as an applying surface, the applying surface rubbing a line with the rod-shaped cosmetic material to extend the line to be tapered.

Advantageous Effects of Invention

Thus, the present invention can provide a rod-shaped cosmetic material feeding container that can easily and beautifully form a tapered line with a good touch.

DESCRIPTION OF EMBODIMENTS

Figure 1:
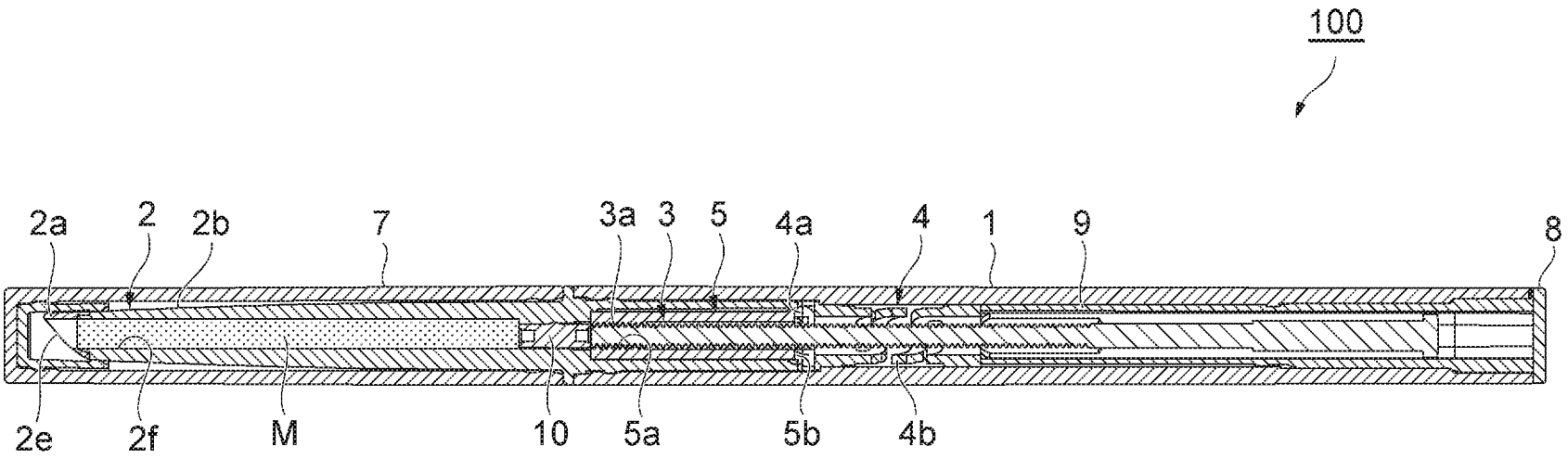
FIG. 1 is a longitudinal cross-sectional view illustrating a rod-shaped cosmetic material feeding container according to a first embodiment of the present invention.

The following describes preferred embodiments of a rod-shaped cosmetic material feeding container according to the present invention with reference to FIG. 1 to FIG. 20. FIG. 1 to FIG. 15 illustrate a first embodiment of the present invention, FIG. 16 to FIG. 20 illustrate a second embodiment of the present invention. The same reference numerals are attached to the same elements in the respective drawings, and an overlapping description will be omitted.

First, the following describes the first embodiment, which is illustrated in FIG. 1 to FIG. 15.

Figure 2:
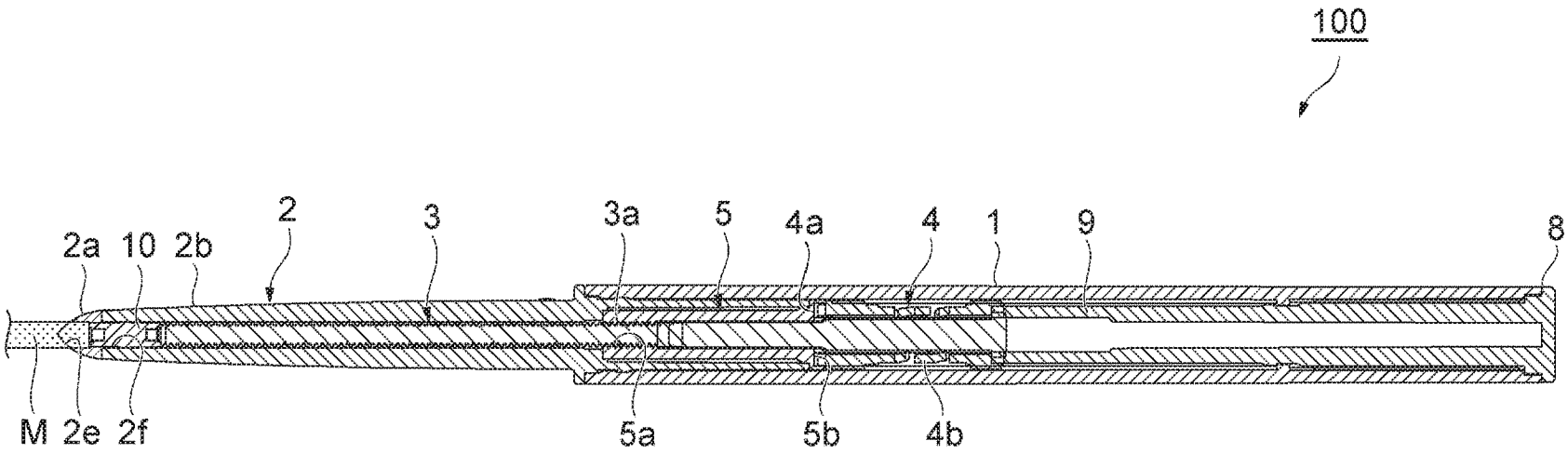
FIG. 2 is an orthogonal, longitudinal cross-sectional view of FIG. 1 and is a longitudinal cross-sectional view illustrating a state of removing a cap from the rod-shaped cosmetic material feeding container in FIG. 1 and advancing a rod-shaped cosmetic material up to an advance limit.
Figure 3:
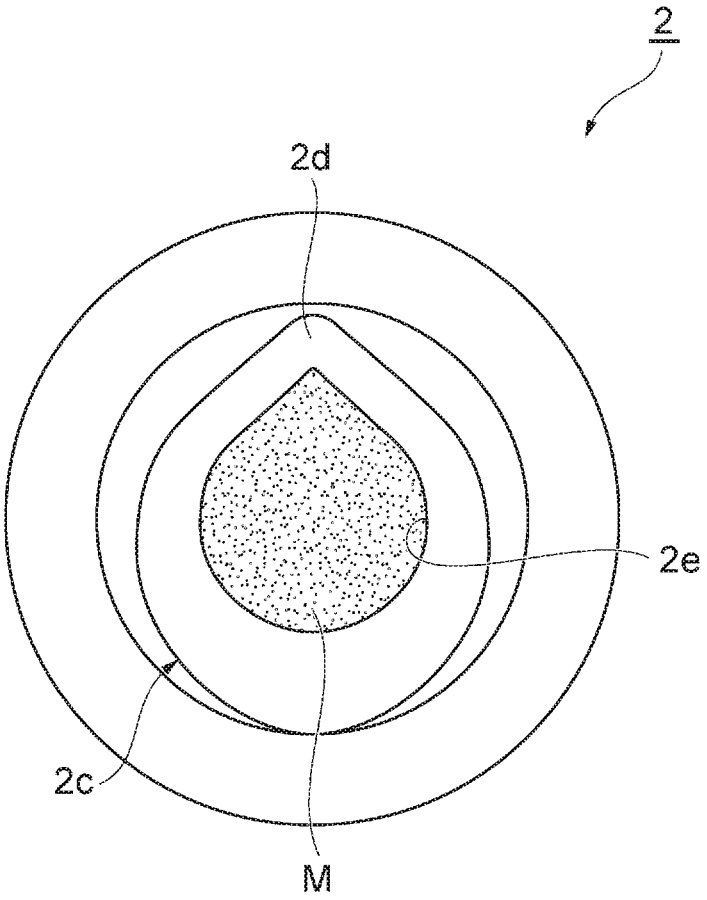
FIG. 3 is a left side view where the cap is removed from the rod-shaped cosmetic material feeding container in FIG. 1.
Figure 4:
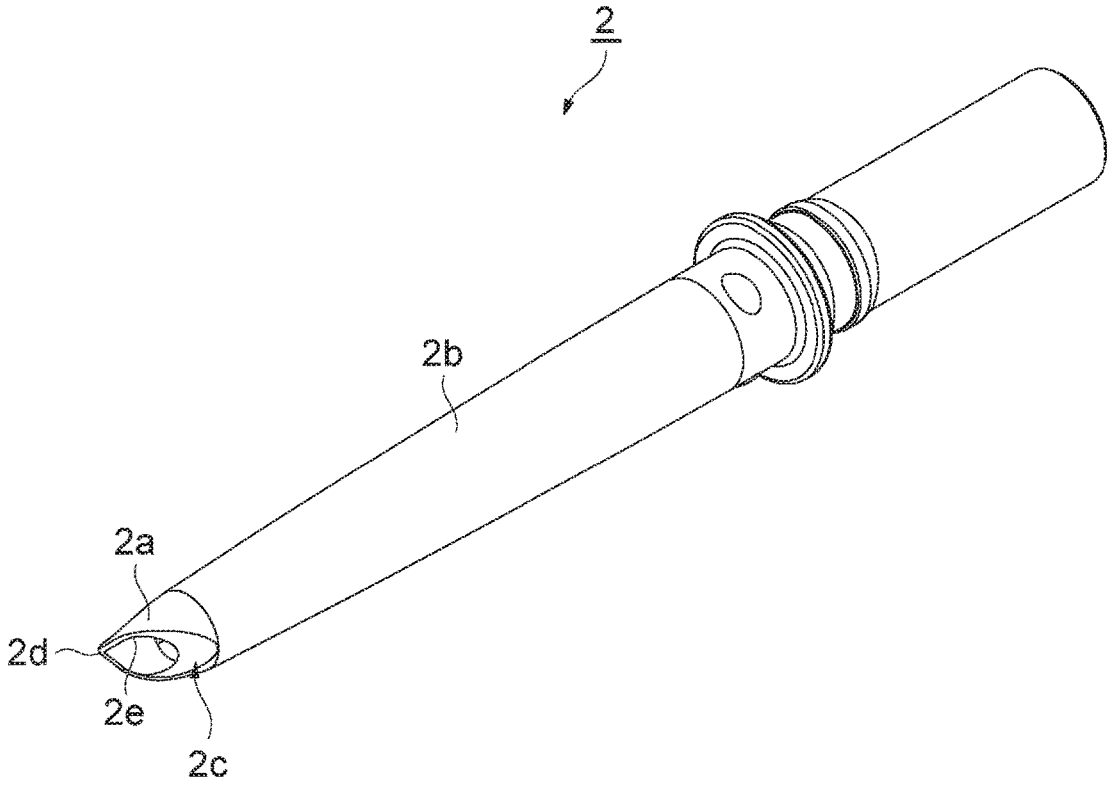
FIG. 4 is a perspective view illustrating a leading tube in FIG. 1 to FIG. 3.
Figure 5:
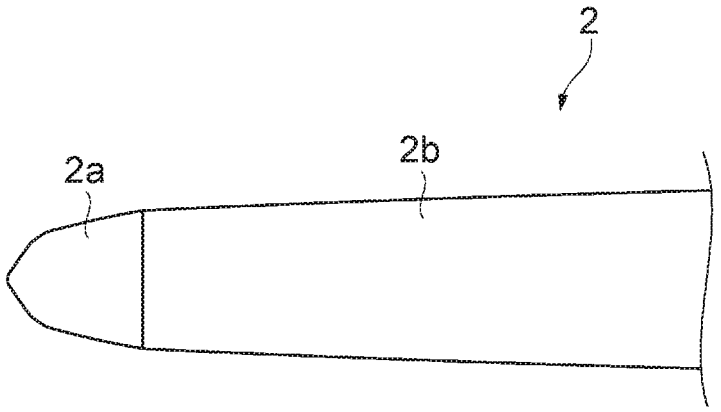
FIG. 5 is a plan view illustrating a tip side of the leading tube in FIG. 1.

FIG. 1 is a longitudinal cross-sectional view illustrating a rod-shaped cosmetic material feeding container according to the first embodiment of the present invention. FIG. 2 is an orthogonal, longitudinal cross-sectional view of FIG. 1 and is a longitudinal cross-sectional view illustrating a state of removing a cap from the rod-shaped cosmetic material feeding container in FIG. 1 and advancing a rod-shaped cosmetic material up to an advance limit. FIG. 3 is a left side view where the cap is removed from the rod-shaped cosmetic material feeding container in FIG. 1. FIG. 4 is a perspective view illustrating a leading tube. FIG. 5 to FIG. 10 are plan views each illustrating a tip side of the leading tube.

As illustrated in FIG. 1 and FIG. 2, the rod-shaped cosmetic material feeding container of the embodiment is used by appropriately feeding the rod-shaped cosmetic material housed in the container by a user. As especially preferable one, the following describes the rod-shaped cosmetic material as an eyeliner M and the rod-shaped cosmetic material feeding container as an eyeliner feeding container 100.

The eyeliner feeding container 100 roughly includes a container main body 1 and a leading tube 2, which constitute an outer shape of the container, a movable body 3 and a ratchet spring member 4, which are housed in the container main body 1, a female screw member 5 housed in the leading tube 2, a cap 7 removably mounted to the leading tube 2 so as to cover the leading tube 2, and a piston 10 that extrudes the eyeliner M at an inside of the leading tube 2.

The container main body 1, which is formed into a long cylindrical shape, is a part gripped by the user to form an eyeline. A rear end of the container main body 1 is closed by a tail plug 8. This tail plug 8 has a projection 9 extending long forward in the container main body 1. Although a detailed description of the leading tube 2 will be described later, the leading tube 2, which is formed into a tapered cylindrical shape, is mounted rotatable to the container main body 1 and unmovable in an axial direction.

The ratchet spring member 4 is formed into an approximately cylindrical shape. The ratchet spring member 4 includes ratchet teeth 4*a* on the front end portion and a spring 4*b* extendable in the axial direction. The female screw member 5, which has an approximately cylindrical shape, includes a female screw 5*a*, which constitutes one of a screw engagement mechanism on an inner peripheral surface on the front side, and ratchet teeth 5*b* projecting rearward. The spring 4*b* of the ratchet spring member 4 biases the ratchet teeth 4*a* of the ratchet spring member 4 forward to be engageable (meshable) with the ratchet teeth 5*b* of the female screw member 5 in a rotation direction around an axis line.

These ratchet teeth 4*a* and 5*b* allow only a relative rotation of the leading tube 2 with which the female screw member 5 engages in the rotation direction to the container main body 1 with which the ratchet spring member 4 engages in the rotation direction in one direction (feed direction of the movable body 3) and restricts a relative rotation in the other direction (feedback direction of the movable body 3), a direction opposite to the one direction. The movable body 3 is a long axis body and has a male screw 3*a* on the front half portion in the axial direction. The movable body 3 includes the male screw 3*a* on the outer peripheral surface. The female screw 5*a* of the female screw member 5 is threadably mounted on the male screw 3*a*.

With the eyeliner feeding container 100 thus configured, when the user removes the cap 7 illustrated in FIG. 1 from the leading tube 2 and the container main body 1 is rotated relatively to the leading tube 2 in the one direction, the ratchet teeth 4a and 5*b* synchronize with the rotation and are rotated relatively in the one direction. In association with this relative rotation, a screwing action by the female screw 5*a* and the male screw 3*a* works, thus advancing the movable body 3. The piston 10, which is positioned ahead of the movable body 3, sequentially feeds the eyeliner M in the leading tube 2 forward. The eyeliner M appears from an opening 2*e* on the leading tube 2 for use.

The following describes the leading tube 2, a feature of the embodiment.

As illustrated in FIG. 4, the leading tube 2 is formed into an approximately cylindrical shape and has a gradually tapered shape as approaching a tip. The leading tube 2 includes a tip end 2*a*, and a main body 2*b*, which is installed consecutively to the tip end 2*a* and extends long rearward.

The tip end 2*a* is made of a soft material while the main body 2*b* is made of a hard material. The tip end 2*a* and the main body 2*b* are formed by two-color molding.

As the soft material constituting the tip end 2*a,* for example, a thermoplastic elastomer or a rubber is employed. As the hard material constituting the main body 2*b,* for example, a thermoplastic resin such as a polypropylene (PP), a polybutylene terephthalate (PBT), an ABS resin, a polyethylene (PE), a polystyrene (PS), a polyvinyl chloride, a polyester, or a polyamide; or a metal is employed.

As a combination of the soft material, which constitutes the tip end 2*a,* with the hard material, which constitutes the main body 2*b,* for example, the thermoplastic elastomer and the PP, the thermoplastic elastomer and the PBT, and the thermoplastic elastomer and the ABS resin, are preferable.

Although the tip end 2*a* and the main body 2*b* are formed by the two-color molding, the leading tube 2 may be configured by installing different components.

Figure 6:
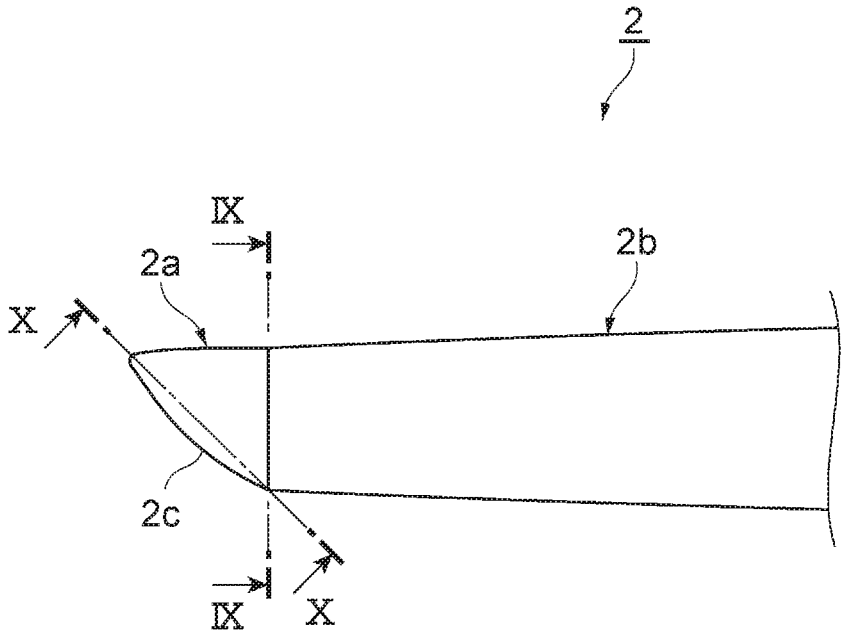
FIG. 6 is a front view illustrating the tip side of the leading tube in FIG. 1.
Figure 7:
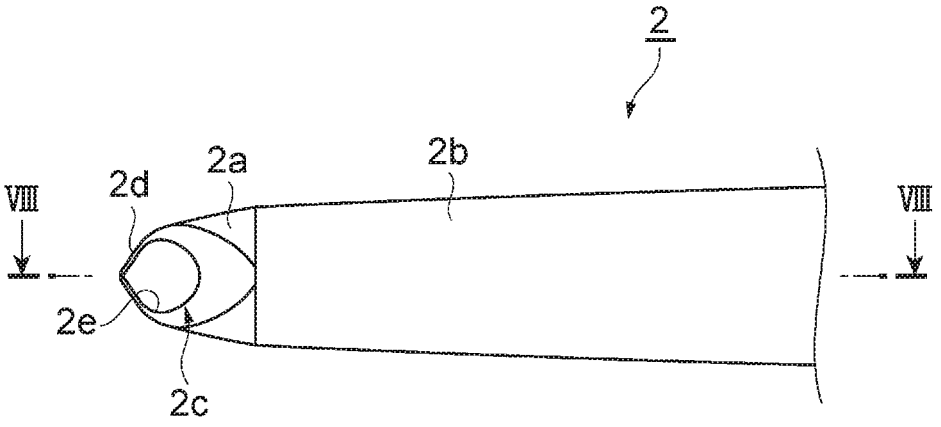
FIG. 7 is a bottom view illustrating the tip side of the leading tube in FIG. 1.
Figure 8:
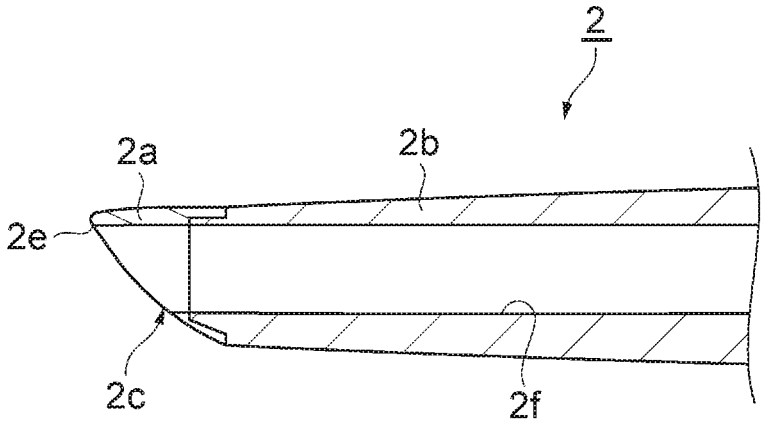
FIG. 8 is a cross-sectional view taken along a line VIII-VII in FIG. 7.

A top end surface 2*c* on the tip end 2*a* of the leading tube 2 forms an inclined surface (see FIG. 4, FIG. 6, and FIG. 8) inclined to a vertical cross-sectional surface with respect to an axis center of the leading tube 2. The top end surface 2*c* also has a shape tapered to the inclined surface (see FIG. 4, FIG. 5, and FIG. 7). As illustrated in FIG. 6 and FIG. 8, the inclined surface forming the top end surface 2*c* curves so as to slightly bulge to the outside. As illustrated in in FIG. 3, the inclined top end surface 2*c* has a shape where a tapered surface 2*d* is tapered so as to peak to an upper side (outside) in the drawing, which is a tip side, viewed from the tip side (in the axial direction view) is provided. Additionally, the top end surface 2*c,* which is on the lower side with respect to this tapered surface 2*d* in the drawing, becomes a surface of largely curving so as to project to the lower side in the drawing.

More specifically, viewed from the tip side, the top end surface 2*c* has a drop shape. A surface on the tapered tip side in the top end surface 2*c* becomes the tapered surface 2*d.* As long as the tapered surface 2*d* is tapered so as to peak to the outside viewed from the tip side, the tip of the tapered surface 2*d* may be slightly rounded or may project acutely so as to have a vertex position. This tapered surface 2*d* serves as an applying surface to extend the eyeline to be tapered with the eyeliner M (details will be described later).

When viewed from the tip side, the opening 2*e* and a tube hole 2*f,* which extends long rearward continuous with the opening 2*e,* of the leading tube 2 have a shape of connecting outlines (inner edges) tapered in a direction identical to the outer edge of the tapered surface 2*d* on the upper side of the circular opening 2*e* and tube hole 2*f* in the drawing. Viewed from the tip side (on a lateral cross-sectional surface), the long eyeliner M housed in the tube hole 2*f* of the leading tube 2 also has a shape of connecting outlines (outer edges) tapered in the direction identical to the outer edge of the tapered surface 2*d* on the upper side of the circular shape in the drawing. That is, the opening 2*e,* the tube hole 2*f,* and also the eyeliner M have the drop shape viewed from the tip side. The outline of the eyeliner M at the part corresponding to the outer edge of the tapered surface 2*d* has a shape similar to this tapered surface 2*d.*

Here, the eyeliner M with such shape is comparatively soft. For example, the eyeliner M is obtained by casting a melted cosmetic material from the opening 2*e* on the leading tube 2 of the assembled eyeliner feeding container 100 into the tube hole 2*f* and hardens the cosmetic material. A hard eyeliner can also be used, and this eyeliner may be inserted from the opening 2*e* into the leading tube 2.

Figure 9:
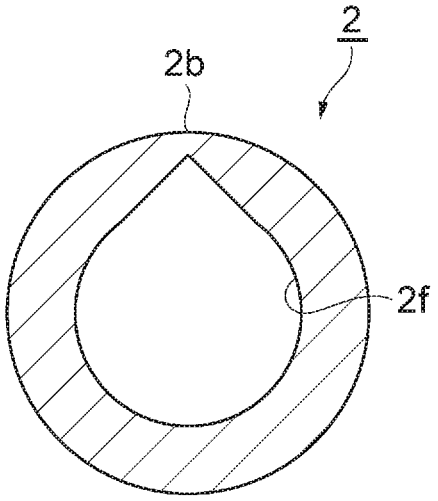
FIG. 9 is a cross-sectional view taken along a line IX-IX in FIG. 6.
Figure 10:
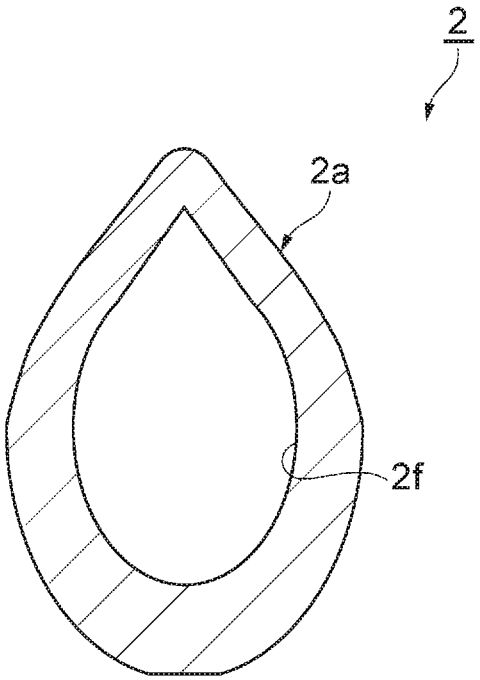
FIG. 10 is a cross-sectional view taken along a line X-X in FIG. 6.

FIG. 9 is a cross-sectional view taken along a line IX-IX in FIG. 6. FIG. 10 is a cross-sectional view taken along a line X-X in FIG. 6. As illustrated in FIG. 9, a cross-sectional surface of the leading tube 2 when the leading tube 2 is cut off along a vertical cross-sectional surface with respect to the axis center of the leading tube 2 has a circular shape, and a cross-sectional shape of the tube hole 2*f* has a drop shape. As illustrated in FIG. 10, when the tip end 2*a* and the tube hole 2*f* are viewed from a direction perpendicular to the top end surface 2*c,* the cross-sectional surface of the leading tube 2 becomes the drop shape. Additionally, the drop-shaped tube hole 2*f* further extends in a longer axis direction.

The following describes how to apply the eyeline with the eyeliner feeding container 100 with the above-described configuration.

FIG. 11 to FIG. 14 are explanatory views when the eyeline is applied. FIG. 15 is a drawing to give an explanation making a posture of the container illustrated in FIG. 11 to FIG. 14 correspond to the shape of the eyeline. Since FIG. 15 is an explanatory view to make the container posture correspond to the shape of the eyeline, the eyeline is applied in a straight line (is not applied to have a curved shape such as a line on an edge of the actual eyelid and a winged line).

Figure 11:
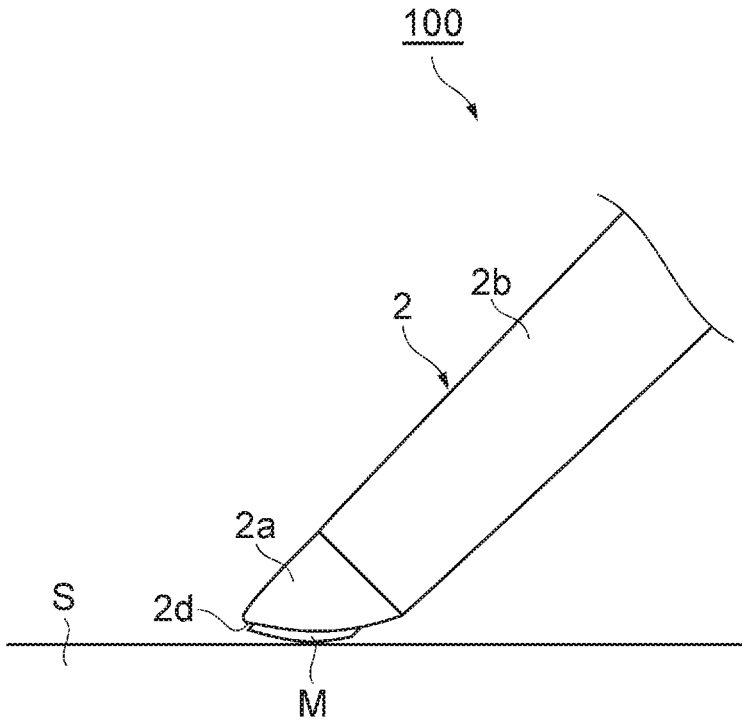
FIG. 11 is an explanatory view when an eyeline is applied.
Figure 12:
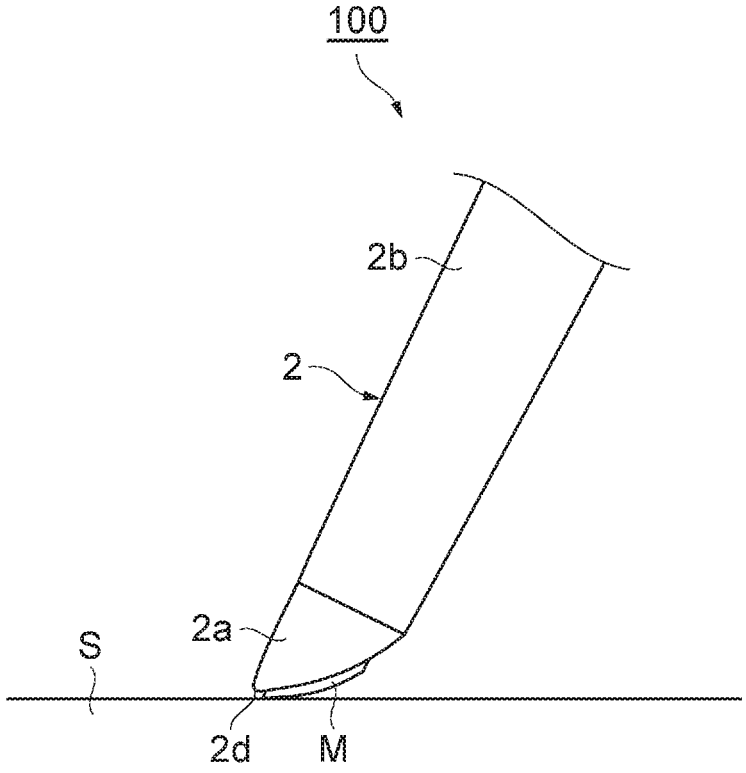
FIG. 12 is an explanatory view when the eyeline is applied continuous with FIG. 11.
Figure 13:
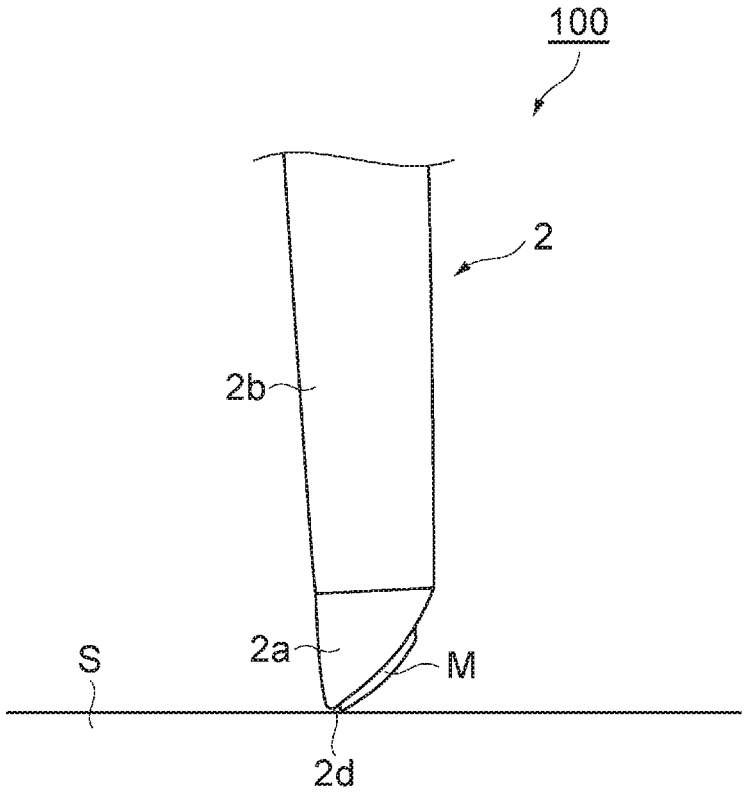
FIG. 13 is an explanatory view when the eyeline is applied continuous with FIG. 12.

First, as illustrated in FIG. 11 and FIG. 15, the leading tube 2 is inclined and the eyeliner M at the tip end 2*a* of the leading tube 2 is touched on an applied portion S. The tapered surface 2*d* on the leading tube 2 is made opposed to the applied portion S to bring the eyeliner M in contact with the applied portion S, thus drawing an eyeline A with a constant thickness. To draw the eyeline A, as illustrated in FIG. 12 and FIG. 13, the inclined leading tube 2 is gradually erected. At this time, the surface of the eyeliner M in contact with the applied portion S gradually moves to the tip side of the drop-shaped eyeliner M. Accordingly, strictly speaking, the eyeline A has a shape thinned little by little.

Figure 14:
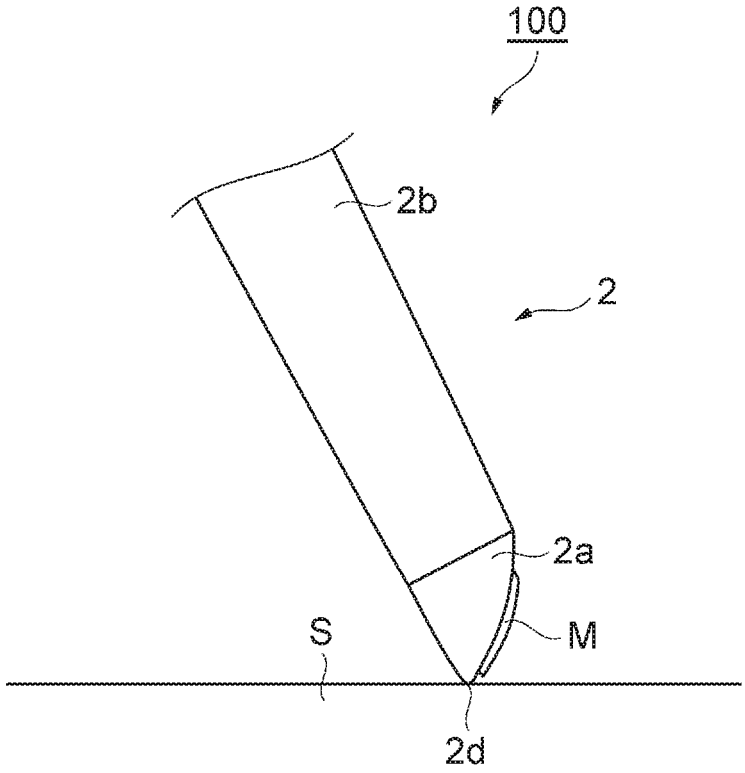
FIG. 14 is an explanatory view when the eyeline is applied continuous with FIG. 13.
Figure 15:
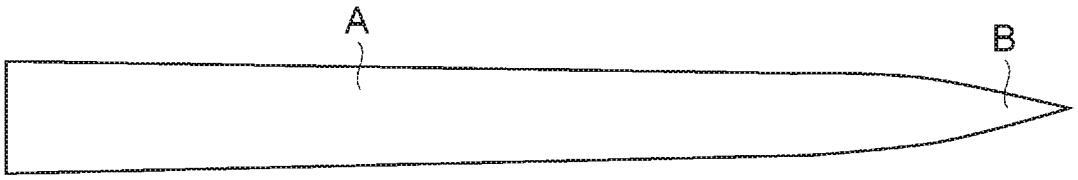
FIG. 15 is a drawing to give an explanation making a posture of the container illustrated in FIG. 11 to FIG. 14 correspond to a shape of the eyeline.

As illustrated in FIG. 13 to FIG. 15, after the leading tube 2 is erected, the leading tube 2 is inclined in a direction opposite to the above-described direction. While the eyeliner M is separated from the applied portion S, the tapered surface 2*d* on the leading tube 2 is brought in contact with the applied portion S to draw a tapered eyeline B. The eyeline B is tapered more than the eyeline A to form, for example, the winged line on the applied portion S. The eyeliner M is separated from the applied portion S, and the tapered surface 2*d* is pressed against and rubbed on the applied portion S, thus forming the eyeline B.

As described above, the embodiment can easily and beautifully form the tapered winged line with good touch as follows. The tapered surface 2*d* is positioned at the upstream when the eyelines A and B are formed. The eyeliner M is touched on the edge of the eyelid (applied portion S) to draw the eyeline A with a constant thickness. When the application comes to a stage of the application of the eyeline B, which is the tapered winged line at the corner of the eye, an angle of the eyeliner feeding container 100 is changed such that the tapered surface 2*d* touches the corner of the eye and the eyeliner M separates from the corner of the eye. Then, the eyeline B is drawn such that the tapered surface 2*d* on the tip end 2a, which is made of the soft material, rubs the corner of the eye. That is, the eyeliner feeding container 100 of the embodiment allows appropriately using both the eyeline A with the constant thickness and the tapered eyeline B by the tapered surface 2*d* on the tip end 2*a* of the leading tube 2 according to the situation only with the eyeliner M.

Viewed from the tip side, the opening 2*e* and the eyeliner M are configured to have the shape with the outline tapered in the direction identical to the outer edge of the tapered surface 2*d*. Accordingly, at a point when the angle of the eyeliner feeding container 100 is changed such that the tapered surface 2*d* on the tip end 2*a* touches the corner of the eye and the eyeliner M separates from the corner of the eye, the tapered eyeline B has already been applied by the tip cosmetic material surface with the peak head surrounded by the tapered outline of the eyeliner M. As a result of rubbing the eyeline B at the tip by the tapered surface 2*d* of the tip end 2*a*, the further beautifully tapered winged line can be formed.

The top end surface 2*c* on the tip end 2*a* is the inclined surface inclined to the vertical cross-sectional surface with respect to the axis center of the leading tube 2. Since the tip side of the top end surface 2*c* has the tapered surface 2*d*, the eyelines A and B can be applied with the inclined eyeliner feeding container 100 while a mirror is seen. Accordingly, the eyeliner feeding container 100 does not hinder the application.

The outer edge of the top end surface 2*c* including the tapered surface 2*d* on the tip end 2*a* has the drop shape in the axial direction view. Therefore, this simple shape, the drop shape, allows forming the beautifully tapered eyeline B. The shape of the outer edge of the top end surface 2*c* is not limited to the drop shape. The shape may be, for example, a triangular shape, a rhombic shape, and a rugby ball shape.

The embodiment forms the tip end 2*a* of the leading tube 2 with the soft material and forms the main body 2*b* with the hard material. The formation of the entire leading tube with the hard material leads to a poor touch when the corner of the eye is rubbed by the tapered surface of the tip end. The formation of the entire leading tube with the soft material leads to a breakage of the rod-shaped cosmetic material when a pressing force is applied to the leading tube from the outside.

Figure 16:
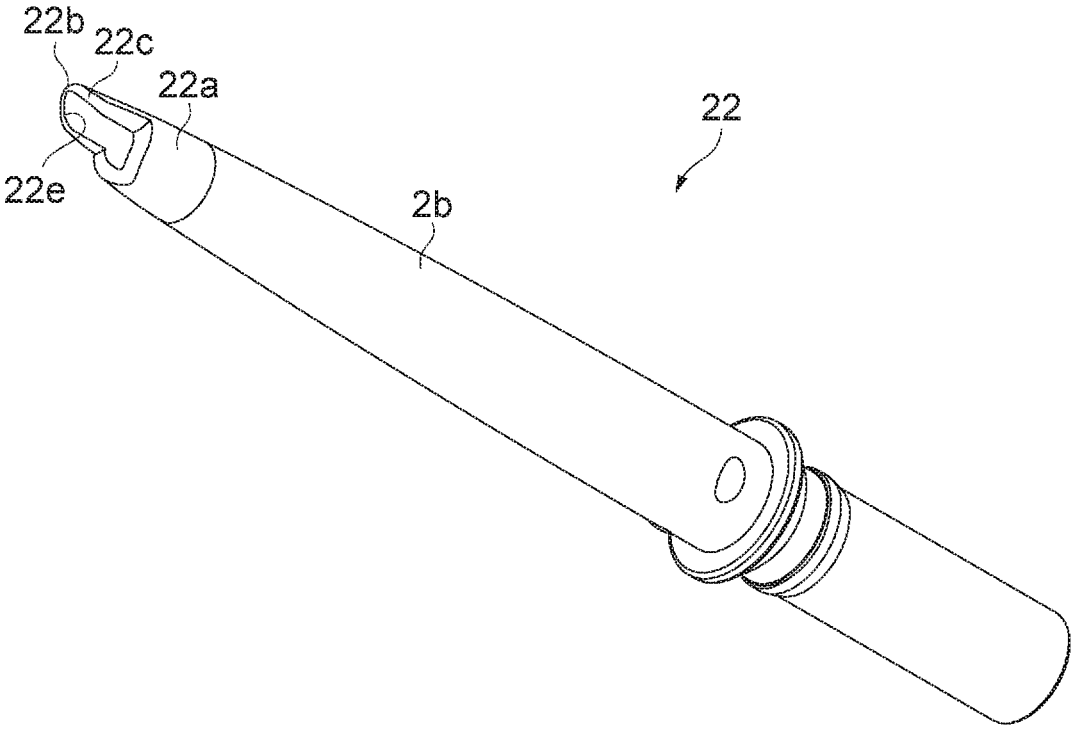
FIG. 16 is a perspective view illustrating a leading tube of a rod-shaped cosmetic material feeding container according to a second embodiment of the present invention.
Figure 17:
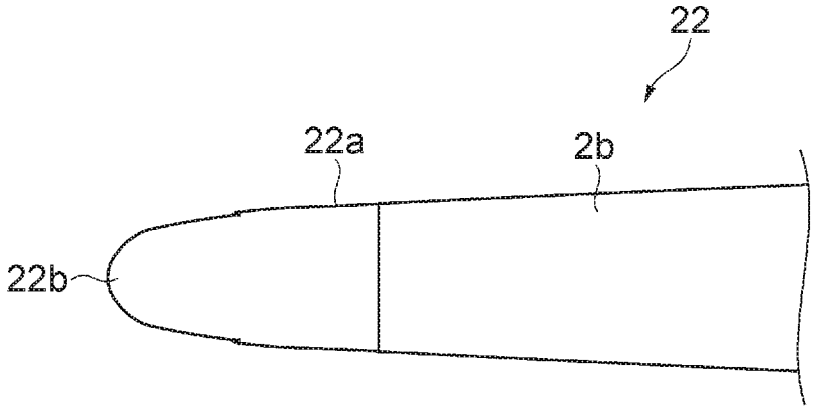
FIG. 17 is a plan view of a tip side of the leading tube illustrated in FIG. 16.
Figure 18:
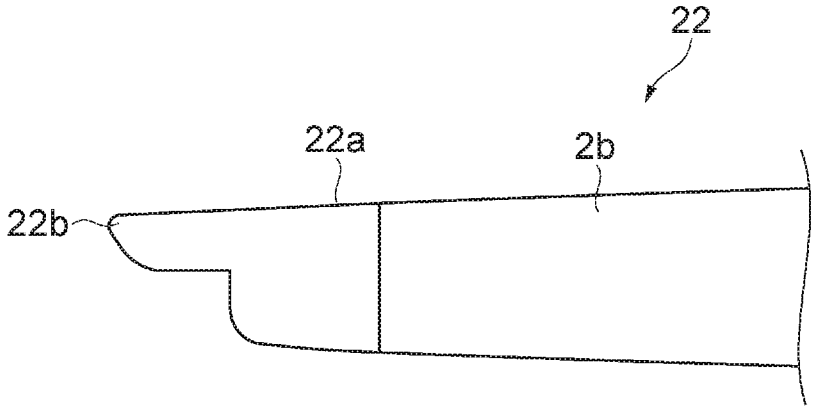
FIG. 18 is a front view of the tip side of the leading tube illustrated in FIG. 16.
Figure 19:
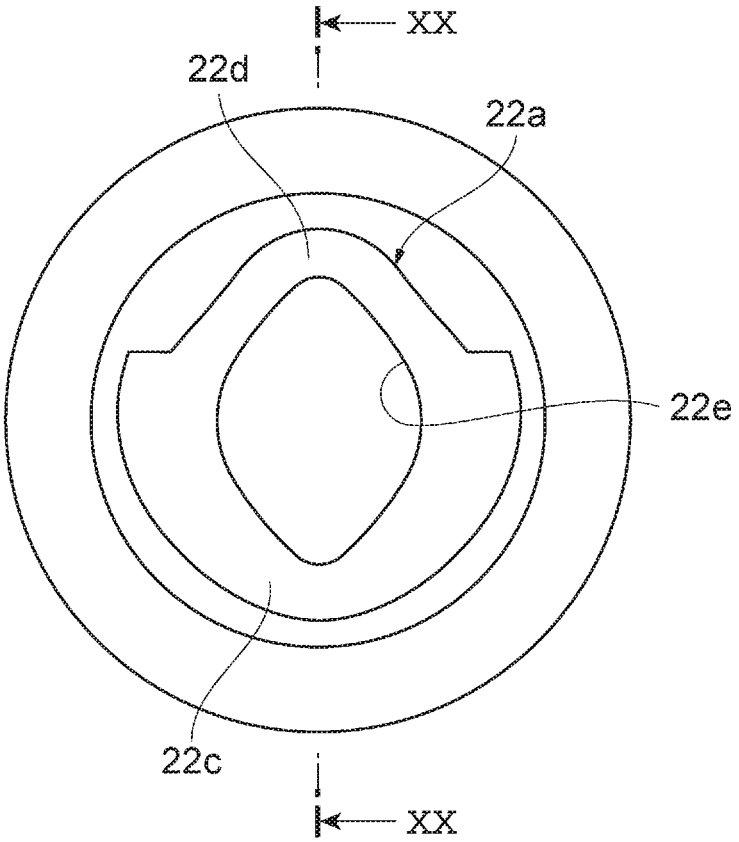
FIG. 19 is a left side view of the tip side of the leading tube illustrated in FIG. 16.
Figure 20:
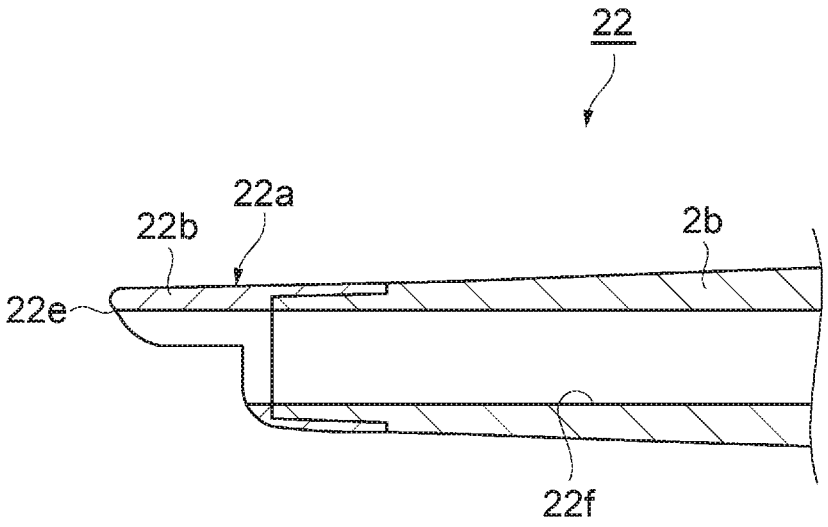
FIG. 20 is a cross-sectional view taken along a line XX-XX in FIG. 19.

FIG. 16 is a perspective view illustrating a leading tube of a rod-shaped cosmetic material feeding container according to a second embodiment of the present invention. FIG. 17 is a plan view of a tip side of the leading tube. FIG. 18 is a front view of the tip side of the leading tube. FIG. 19 is a left side view of the tip side of the leading tube. FIG. 20 is a cross-sectional view taken along a line XX-XX in FIG. 19.

A difference of the second embodiment from the first embodiment is to change a configuration of a tip end 22*a* of a leading tube 22. Specifically, a part of the tip end 22*a* has a projection 22*b* that extends forward to cover the eyeliner in an eaves shape. A top end surface 22*c* of this projection 22*b* has a tapered surface 22*d* tapered so as to peak to the outside viewed from the tip side.

Viewed from the tip side, the projection 22*b* has a shape with rounded corners of a rhombic tube at one end side part with a longer axis, and the top end surface 22*c* at this part has the tapered surface 22d.

Here, an opening 22*e* and a tube hole 22*f* of the leading tube 22 and the eyeliner (not illustrated) have the shape whose rhombic corners are rounded viewed from the tip side. The outline of the part corresponding to an outer edge of the top end surface 22*c* on the projection 22*b* is tapered in a direction identical to this tapered surface 22*d*. Here, viewed from the tip side, outlines of the opening 22*e*, the tube hole 22*f*, and also the eyeliner at parts corresponding to the outer edge of the tapered surface 22*d* of the projection 22*b* have a shape similar to this tapered surface 22*d*.

Thus, even with the configuration where the top end surface 22*c* of the projection 22*b*, which covers the eyeliner in the eaves shape, includes the tapered surface 22*d*, similar to the first embodiment, this embodiment can easily and beautifully form the tapered winged line with good touch as follows. The tapered surface 22*d* is positioned at the upstream when the eyelines are formed. The eyeliner is touched on the edge of the eyelid to draw the eyeline with a constant thickness. When the application comes to a stage of the application of the tapered winged line at the corner of the eye, an angle of the eyeliner feeding container is changed such that the tapered surface 22*d* touches the corner of the eye and the eyeliner separates from the corner of the eye. Then, the eyeline is drawn such that the tapered surface 22*d* on the tip end 22*a*, which is made of the soft material, rubs the corner of the eye.

Similar to the first embodiment, viewed from the tip side, the opening 22*e* and the eyeliner are configured to have the shape with the outline tapered in the direction identical to the outer edge of the tapered surface 22*d*. Accordingly, at a point when the angle of the eyeliner feeding container is changed such that the tapered surface 22*d* on the tip end 22*a* touches the corner of the eye and the eyeliner separates from the corner of the eye, the tapered eyeline has already been applied by the tip cosmetic material surface with the peak head surrounded by the tapered outline of the eyeliner. As a result of rubbing the tapered eyeline by the tapered surface 22*d* of the tip end 22*a*, the further beautifully tapered winged line can be formed.

While the present invention has been specifically described on based on the embodiment, the present invention is not limited to the embodiment. For example, the opening 2*e*, the tube hole 2*f*, and the eyeliner M are not tapered viewed from the tip side but may have, for example, a circular shape (a column-shaped eyeliner and a circular opening and tube hole on the cross section). In this case as well, drawing the eyeline such that the tapered surface on the tip end made of the soft material rubs the corner of the eye allows easily and beautifully forming the tapered winged line with good touch.

As long as the tapered surface of the tip end has the tapered surface tapered so as to peak to the outside viewed from the tip side, the shape of the top end surface on the tip end other than that and the shapes of the opening, the tube hole, and the eyeliner are not especially limited. The shapes may be an elliptical shape, a flat shape, an angular shape, or a similar shape viewed from the tip side. Note that, the opening and the eyeliner have the similar shape viewed from the tip side.

To easily apply the beautifully tapered winged line at the corner of the eye, the embodiment includes the tapered surfaces 2*d* and 22*d* on the top end surface 2*c*, which forms the inclined surface, of the leading tube 2 and the top end surface 22*c* on the projection 22*b*. For example, this embodiment is also applicable to the case where a top end surface on a leading tube has a flat surface perpendicular to an axis center of this leading tube. It is only necessary to include a tapered surface on the flat top end surface in this case as well. This case can also easily and beautifully form the tapered winged line with good touch as follows. The tapered surface is positioned at the upstream when the eyelines are formed. The eyeliner is touched on the edge of the eyelid to draw the eyeline with a constant thickness. When the application comes to a stage of the application of the tapered winged line at the corner of the eye, an angle of the eyeliner feeding container is changed such that the tapered surface touches the corner of the eye and the eyeliner separates from the corner of the eye. Then, the eyeline is drawn such that the tapered surface on the tip end, which is made of the soft material, rubs the corner of the eye.

The embodiment describes the application to apply the beautifully tapered winged line at the corner of the eye with the rod-shaped cosmetic material as the eyeliner M as especially preferable. For example, the embodiment is also applicable to apply the beautifully tapered winged line at an end of an eyebrow with the rod-shaped cosmetic material as an eyebrow pencil. The embodiment is also applicable to apply a beautifully tapered winged line at a corner of a mouth with the rod-shaped cosmetic material as a lipstick. In short, the embodiment is applicable to various rod-shaped cosmetic materials. The application to apply the winged line is described as especially preferable. This embodiment is also applicable to a line that is not swept up, ensuring applying the beautiful tapered line in this case as well.

The embodiment is applicable not only to the rod-shaped cosmetic material feeding container that extrudes the rod-shaped cosmetic material by the piston but is also applicable to the following rod-shaped cosmetic material feeding containers. For example, a rod-shaped cosmetic material feeding container disclosed in Japanese Unexamined Patent Application Publication No. 2014-221147 supports a rear end portion of a rod-shaped cosmetic material with a plurality of support pieces separately arranged side by side around the peripheral area so as to interpose the rear end portion and advances and retreats the rod-shaped cosmetic material. For example, a rod-shaped cosmetic material feeding container disclosed in Japanese Unexamined Patent Application Publication No. 2014-200532 holds a rear end portion of a rod-shaped cosmetic material with a closed-bottomed cylindrical holding pipe to advance and retreat the rod-shaped cosmetic material. To thus advance and retreat the rod-shaped cosmetic material, the above-described ratchet mechanism, which is constituted of the ratchet teeth 4*a* and 5*b* of the ratchet spring member 4 and the female screw member 5, is unnecessary. To generate a clicking feel at the feed and the feedback of the rod-shaped cosmetic material, the ratchet mechanism may be simply replaced by a click mechanism.

The click mechanism may be eliminated.

The embodiment is also applicable to the following rod-shaped cosmetic material feeding container. The container main body 1 is configured as a leading tube of integrating the container main body 1 with the leading tube 2 or 22 positioned on the front side with respect to this container main body 1. The tail plug 8 has a function similar to that of the container main body 1. The relative rotation of these members (the leading tube and the tail plug) feeds the movable body.

Further, the embodiment is not limited to one that feeds the rod-shaped cosmetic material through the relative rotation but is also applicable to a type that feeds the rod-shaped cosmetic material through knocking of a knock operating portion like a well-known pencil type knock system. In short, the embodiment is applicable to all types that feed a rod-shaped cosmetic material through the operation of the operating portion.

In the above embodiment, the operating portion corresponds to a member to be relatively rotated like the leading tubes 2 and 22 and the container main body 1.

What is claimed is:

1. A rod-shaped cosmetic material feeding container comprising:

a movable body housed in a container main body, the movable body advancing by an operation of an operating portion, and a leading tube positioned on a front side of the container main body: wherein a rod-shaped cosmetic material is housed within an elongated tube hole of the leading tube that has a drop shape in cross-section, wherein both the rod-shaped cosmetic material and an opening on a tip end of the leading tube has the drop shape in cross-section when viewed from the tip side, the rod-shaped cosmetic material being fed by the advance of the movable body to project from the opening;

the leading tube has the tip end and a main body, the tip end being made of a soft material, the main body being installed consecutively to the tip end and extending in an axial direction, the main body of the leading tube being made of a hard material and having the elongated tube hole formed therein; and a top end surface on the tip end has a tapered surface tapered to peak at an outside surface of the tip end when viewed from a tip side.

2. The rod-shaped cosmetic material feeding container according to claim 1, wherein:

the top end surface is an inclined surface inclined to a vertical cross-sectional surface with respect to an axis center of the leading tube, and the inclined surface has the tapered surface on a tip side.

3. The rod-shaped cosmetic material feeding container according to claim 2, wherein:

an outer edge of the top end surface including the tapered surface has the drop shape in cross-section.

4. The rod-shaped cosmetic material feeding container according to claim 2, wherein:

the opening and the rod-shaped cosmetic material have an outline shape with an outline tapered in a direction identical to an outer edge of the tapered surface viewed from a tip side.

5. The rod-shaped cosmetic material feeding container according to claim 2, wherein:

the tapered surface serves as an applying surface, the applying surface rubbing a line with the rod-shaped cosmetic material to extend the line to be tapered.

6. The rod-shaped cosmetic material feeding container according to claim 3, wherein:

the opening and the rod-shaped cosmetic material have an outline shape with an outline tapered in a direction identical to an outer edge of the tapered surface viewed from a tip side.

7. The rod-shaped cosmetic material feeding container according to claim 3, wherein:

the tapered surface serves as an applying surface, the applying surface rubbing a line with the rod-shaped cosmetic material to extend the line to be tapered.

8. The rod-shaped cosmetic material feeding container according to claim 4, wherein:

the tapered surface serves as an applying surface, the applying surface rubbing a line with the rod-shaped cosmetic material to extend the line to be tapered.

9. The rod-shaped cosmetic material feeding container according to claim 6, wherein:

the tapered surface serves as an applying surface, the applying surface rubbing a line with the rod-shaped cosmetic material to extend the line to be tapered.

10. The rod-shaped cosmetic material feeding container according to claim 1, wherein:

an outer edge of the top end surface including the tapered surface has the drop shape in cross-section.

11. The rod-shaped cosmetic material feeding container according to claim 10, wherein:

the opening and the rod-shaped cosmetic material have an outline shape with an outline tapered in a direction identical to an outer edge of the tapered surface viewed from a tip side.

12. The rod-shaped cosmetic material feeding container according to claim 10, wherein:

the tapered surface serves as an applying surface, the applying surface rubbing a line with the rod-shaped cosmetic material to extend the line to be tapered.

13. The rod-shaped cosmetic material feeding container according to claim 11, wherein:

the tapered surface serves as an applying surface, the applying surface rubbing a line with the rod-shaped cosmetic material to extend the line to be tapered.

14. The rod-shaped cosmetic material feeding container according to claim 1, wherein:

the opening and the rod-shaped cosmetic material have an outline shape with an outline tapered in a direction identical to an outer edge of the tapered surface viewed from a tip side.

15. The rod-shaped cosmetic material feeding container according to claim 14, wherein:

the tapered surface serves as an applying surface, the applying surface rubbing a line with the rod-shaped cosmetic material to extend the line to be tapered.

16. The rod-shaped cosmetic material feeding container according to claim 1, wherein:

the tapered surface serves as an applying surface, the applying surface rubbing a line with the rod-shaped cosmetic material to extend the line to be tapered.

17. A rod-shaped cosmetic material feeding container comprising:

a movable body housed in a container main body, the movable body advancing by an operation of an operating portion, and a leading tube positioned on a front side of the container main body: wherein a rod-shaped cosmetic material is housed within an elongated tube hole of the leading tube that has a rhombic shape in cross-section, wherein both the rod-shaped cosmetic material and an opening on a tip end of the leading tube has the rhombic shape in cross-section when viewed from the tip side, the rod-shaped cosmetic material being fed by the advance of the movable body to project from the opening;

the leading tube has the tip end and a main body, the tip end being made of a soft material, the main body being installed consecutively to the tip end and extending in an axial direction, the main body of the leading tube being made of a hard material and having the elongated tube hole formed therein; and a top end surface on the tip end has a tapered surface tapered to peak at an outside surface of the tip end when viewed from a tip side, wherein:

a part of the tip end is a projection, the projection extending forward to cover the rod-shaped cosmetic material in an eaves shape, and a top end surface of the projection has the tapered surface.

18. The rod-shaped cosmetic material feeding container according to claim 17, wherein:

the opening and the rod-shaped cosmetic material have an outline shape with an outline tapered in a direction identical to an outer edge of the tapered surface viewed from a tip side.

19. The rod-shaped cosmetic material feeding container according to claim 17, wherein:

the tapered surface serves as an applying surface, the applying surface rubbing a line with the rod-shaped cosmetic material to extend the line to be tapered.

20. The rod-shaped cosmetic material feeding container according to claim 18, wherein:

the tapered surface serves as an applying surface, the applying surface rubbing a line with the rod-shaped cosmetic material to extend the line to be tapered.

* * * * *